US011338340B2

(12) United States Patent
Freliez

(10) Patent No.: US 11,338,340 B2
(45) Date of Patent: May 24, 2022

(54) SPRAY HEADER FOR SPRAYING A LUBRICATING AND/OR REFRIGERATING FLUID

(71) Applicant: FIVES DMS, Noyelles-les-Seclin (FR)

(72) Inventor: Jérémie Freliez, Villeneuve d'Ascq (FR)

(73) Assignee: FIVE DMS, Noyelles-les-Seclin (FR)

( * ) Notice: Subject to any disclaimer, the term of this patent is extended or adjusted under 35 U.S.C. 154(b) by 555 days.

(21) Appl. No.: 16/337,131

(22) PCT Filed: Sep. 26, 2017

(86) PCT No.: PCT/FR2017/052576

§ 371 (c)(1),
(2) Date: Mar. 27, 2019

(87) PCT Pub. No.: WO2018/060580

PCT Pub. Date: Apr. 5, 2018

(65) Prior Publication Data

US 2019/0224732 A1 Jul. 25, 2019

(30) Foreign Application Priority Data

Sep. 27, 2016 (FR) ..... 16 59089

(51) Int. Cl.
*B21B 45/02* (2006.01)
*B05B 1/16* (2006.01)
(Continued)

(52) U.S. Cl.
CPC ..... *B21B 45/0233* (2013.01); *B05B 1/1672* (2013.01); *B05B 1/20* (2013.01);
(Continued)

(58) Field of Classification Search
CPC ..... B21B 45/0233; B21B 45/0218; B21B 45/0239; B21B 45/0245; B21B 45/0251;
(Continued)

(56) References Cited

U.S. PATENT DOCUMENTS 2,776,586 A 1/1957 Tadeusz
3,212,719 A * 10/1965 Di Corpo ..... B05B 1/1663 239/541
3,827,637 A * 8/1974 Stephany ..... B05B 15/658 239/242
3,854,665 A * 12/1974 Rodgers ..... B05B 3/044 239/242
(Continued)

FOREIGN PATENT DOCUMENTS

JP 62-3203 1/1987
JP 02155506 A * 6/1990 ..... B21B 45/0233
(Continued)

OTHER PUBLICATIONS

English translate (JPH02155506A), retrieved date Jan. 23, 20222.*
International Search Report, PCT/FR2017/052576, dated Dec. 14, 2017.

*Primary Examiner* — Jessica Cahill
*Assistant Examiner* — Mohammed S. Alawadi
(74) *Attorney, Agent, or Firm* — Nixon & Vanderhye

(57) ABSTRACT

Disclosed is a spray ramp intended to lubricate and/or cool a laminated strip and/or pressure cylinders of a mill, including: a tubular shaft of which the hollow interior volume forms a fluid admission chamber; a chassis rigidly connected to the external wall of the shaft, extending along the tubular shaft; a plurality of nozzles distributed over the length of the chassis and supported by the chassis, arranged such that the jets form a fluid curtain; and a pipe system, inside the chassis, ensuring the supply of the nozzles from the through-bores provided in the tubular wall of the hollow shaft. The pipe system includes at least one pressure levelling chamber extending over the whole active length of the chassis and through which all the fluid supplying the plurality of nozzles passes.

20 Claims, 4 Drawing Sheets

(51) Int. Cl.

| | |
|---|---|
| ***B05B 1/20*** | (2006.01) |
| ***B05B 1/30*** | (2006.01) |
| ***B05B 15/65*** | (2018.01) |
| ***B21B 27/10*** | (2006.01) |

(52) U.S. Cl.
CPC ..... *B05B 1/3006* (2013.01); *B05B 15/65* (2018.02); *B21B 27/10* (2013.01); *B21B 45/0218* (2013.01); *B21B 2027/103* (2013.01)

(58) Field of Classification Search
CPC ..... B21B 45/0269; B21B 45/0275; B21B 45/0281; B21B 45/0284; B21B 2027/103; B21B 27/106; B05B 15/65; B05B 15/50; B05B 1/1672; B05B 1/20; B05B 1/3006; B05B 1/50; B05B 1/14; B05B 1/202; C21D 1/667
USPC ..... 266/113; 239/427, 427.5, 550, 566, 533, 239/533.3, 533.5
See application file for complete search history.

(56) References Cited

U.S. PATENT DOCUMENTS

| | | | | |
|---|---|---|---|---|
| 3,998,084 | A | 12/1976 | Rerecich | |
| 5,657,928 | A * | 8/1997 | Jian | B05B 1/3026 239/242 |
| 7,258,286 | B1 * | 8/2007 | Wang | A62C 2/08 239/240 |
| 2007/0235568 | A1 * | 10/2007 | Wang | B05B 3/044 239/562 |
| 2015/0328487 | A1 * | 11/2015 | Shoap | A62C 33/04 239/1 |

FOREIGN PATENT DOCUMENTS

| | | | |
|---|---|---|---|
| JP | H02155506 | A * | 6/1990 |
| JP | 2011-194417 | | 10/2011 |
| JP | 2013-013937 | | 1/2013 |
| WO | WO 2015/071608 | | 5/2015 |
| WO | WO 2016/001541 | | 1/2016 |

* cited by examiner

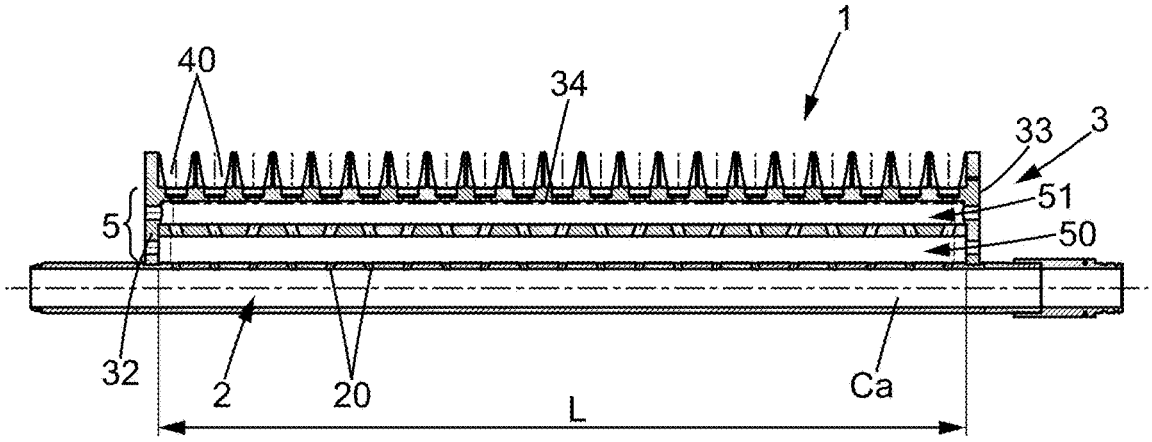
FIG. 5
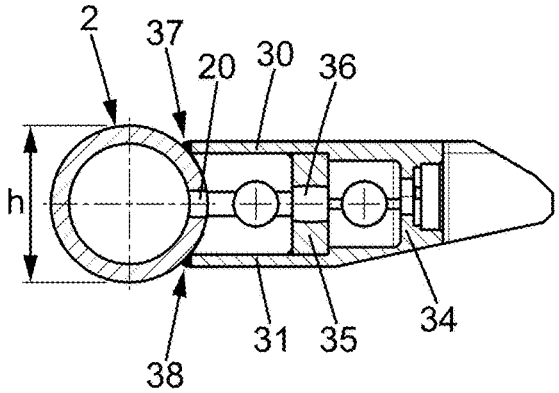
FIG. 6
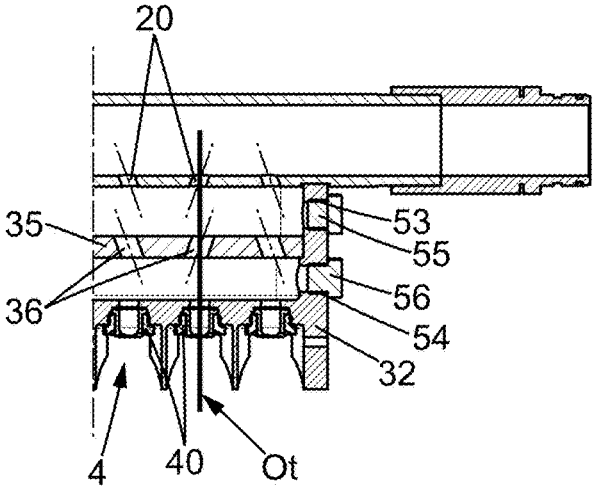
FIG. 7
FIG. 8
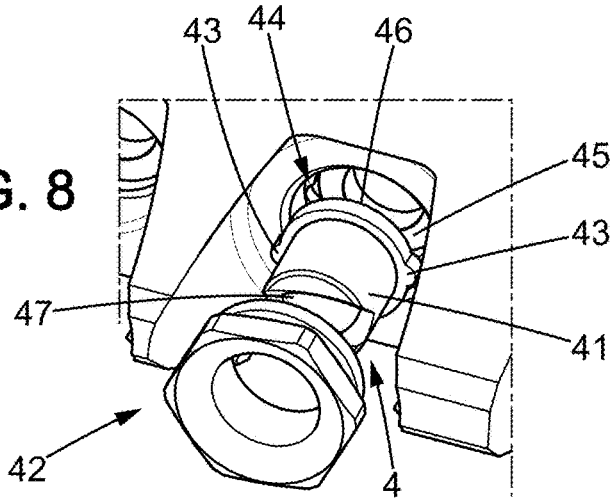

FIG. 9
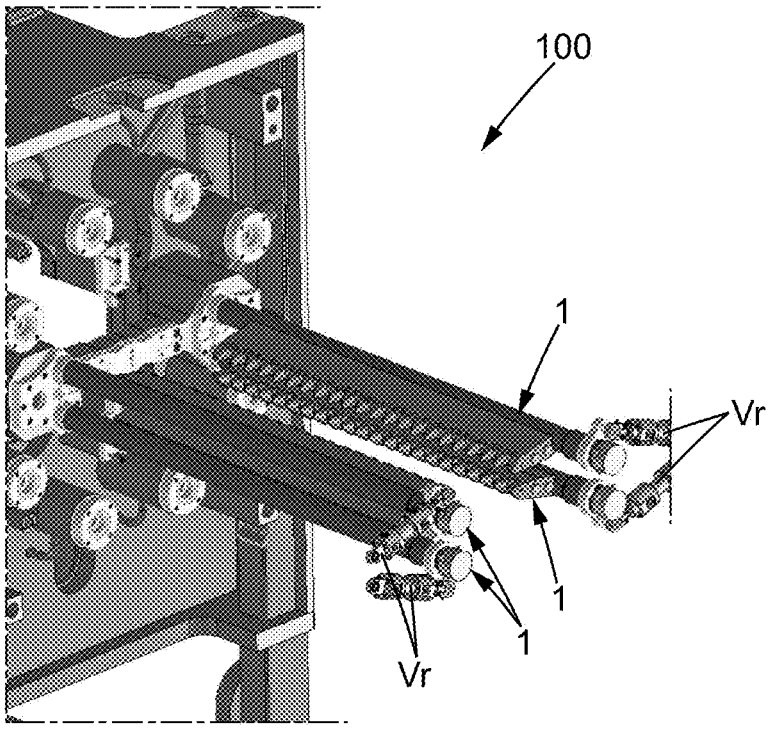
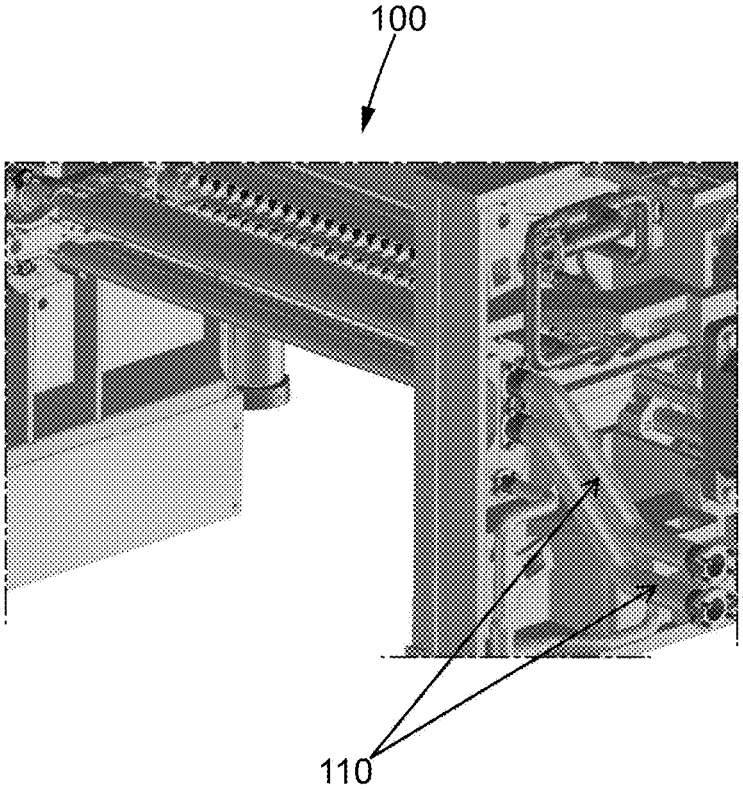
FIG. 10

SPRAY HEADER FOR SPRAYING A LUBRICATING AND/OR REFRIGERATING FLUID

The invention relates to a header for spraying a lubricating and/or refrigerating fluid, in addition to a rolling mill equipped with such a header.

BACKGROUND OF THE INVENTION

The field of the invention is that of rolling mills for metal strips, and more particularly a rolling mill known by a person skilled in the art by the term "20 High". Such a rolling mill, disclosed in the patent document U.S. Pat. No. 2,776,586 comprises a stand in which rolls are arranged.

The rolls comprise two work rolls defining the gap for the strip to be rolled, in addition to a set of first intermediate rolls and a set of second intermediate rolls for supporting each work roll (lower and upper work roll). These rolls are supported by a plurality of sets of rollers bearing against the second intermediate rolls, on either side of the plane of the strip to be rolled.

In a "20 High" type rolling mill, two first intermediate rolls are present, and three of said second intermediate rolls are present (for each upper or lower work roll). Eight sets of rollers bear against the second intermediate rolls, on either side of the plane of the strip to be rolled.

Moreover, lubrication/cooling of the strip and/or the work rolls by spraying a refrigerating/lubricating fluid, at the upper portion and at the lower portion of the strip, is also known. The spraying of this fluid is conventionally carried out by spray headers, given the reference numerals 56a and 57 in FIG. 4 of the patent document U.S. Pat. No. 2,776,586.

These headers extend over the width of the strip to be rolled, in the stand of the roller mill, at a space between the upper intermediate rolls on the one hand, and the lower intermediate rolls on the other hand. These headers are conventionally positioned in the vicinity of the work rolls. Such rolling mills generally comprise two pairs of headers, the two headers of each pair being arranged respectively above and below the plane of the strip to be rolled. The two pairs of headers are conventionally arranged on either side of the rolling plane, passing through the axes of the work rolls.

Each of the spray headers can be pivotably mounted to the stand in order to allow the position of the header to be adjusted relative to the strip, or relative to the nearby rolls. This adjustment takes place by rotating the header about the pivot axis thereof, which is substantially parallel to the plane of the strip and perpendicular to the direction of through-feed of the strip. For this purpose, each header has a rotating shaft, mounted such that it is free to rotate, at the ends thereof, in bearings rigidly connected to the stand. A hydraulic cylinder, connecting the stand and the shaft, allows the header to be rotatably actuated, then to be firmly held in the desired position.

The different possible positions of the headers can in particular allow the rolls to be removed more easily, by distancing the one or more headers from the roll to be changed. The different positions can further ease the insertion of the strip between the work rolls. Thus, and by way of example, the headers of the pair situated upstream, according to the direction in which the strip is inserted, can be moved closer to one another in order to physically guide the end of the strip to be inserted in the gap between the work rolls, whereby the headers of the other pair can be distanced therefrom in order to ease recovery of the strip downstream of the work rolls.

The feeding of refrigerating fluid to the header is carried out from the ends of the rotating shaft of the header, which is hollow (cylindrical tubular shaft), throughout the length thereof, and such that the hollow of the shaft constitutes a fluid intake chamber. A chassis, generally a mechanically-welded chassis, planar overall, is rigidly connected by welding to said hollow shaft, extending along the length of the shaft, parallel to the longitudinal axis thereof. This chassis is designed to support the nozzles, which are evenly distributed over the length of the chassis. These nozzles are arranged on this chassis relative to one another and such that they allow a curtain-like sheet of fluid to be formed. This sheet is intended to spray the strip and/or coils over the entire width/length thereof.

According to this prior art, each of the nozzles is fed with a fluid from the hollow of the shaft constituting the intake chamber, by means of a plurality of individual pipes, each individual pipe opening out, on the one hand, at one of the ends thereof, into the hollow of the shaft, by an orifice made in the cylindrical wall of the shaft, and on the other hand, at a threaded bore to which the nozzle is rigidly connected by screwing.

In order to obtain the homogeneous cooling of the element to be cooled (i.e. the metal strip or the coils), the sheet of fluid generated by the header must cover the element over the entire length/width thereof, and according to a uniform flow rate over said length/width. However in practice, and as a result of loss of load in the pipes upstream of the nozzles, the flow rates of the different nozzles are not identical. The respective flow rates of the different nozzles essentially depend on the positions of the nozzles over the length of the header. For example, and if the tubular shaft was fed with fluid from only one of the two ends thereof, the profile of the flow rates of the nozzles would be increasing, i.e. the flow rates of the nozzles increase the greater the distance from the intake end of the hollow shaft. In practice, such feeding from a single end of the hollow shaft is not practised since it leads to unacceptable flow rate variations.

In such a header design, the intake chamber is thus fed with a refrigerating fluid simultaneously from both ends of the tubular shaft, and at similar pressures and flow rates at these two ends: limited flow rate variations are thus obtained, which are acceptable for the cooling of the strip. Simultaneously feeding each hollow shaft from these two ends thus requires a fluid feed system on both sides of the roll stand of the rolling mill, and in particular at the access door of the rolling mill, on the operator side, through which the different rolls can be removed for maintenance. According to the observations made by the inventor, this feed system on this side of the rolling mill hinders this maintenance access.

Patent document U.S. Pat. No. 3,998,084 discloses a spray header, referred to in this document as a "spray board", which comprises nozzles given the reference numeral 30, distributed along the length of the header, received in bores given the reference numeral 62, and as shown in FIG. 7. According to this prior art, and in order to allow for homogeneous cooling, nozzles having an individual automatic flow rate adjusting system are used. These automatic adjusting systems are used to adjust the nozzle flow rates, independently from one another, so as to homogenise the flow rates over the width of the strip to be cooled. However, such a design requires the use of a large number of expensive nozzles, the adjustment mechanism whereof, having moving parts, is capable of becoming fouled by the lubricant, or of becoming uncalibrated.

Patent document JP 2011 194417 A also discloses a cooling apparatus used in steel rolling. Such an apparatus comprises a feed pipe connected to a nozzle-supporting chassis, comprising an inner pipe and an outer pipe, the cooling water feed pipe being connected to the inner pipe.

The cooling water provided to the inner pipe passes through holes, formed on the upper face thereof, and ends up in the outer pipe before being sprayed externally via the nozzle group.

Such a device has the drawback of not guaranteeing a uniform optimum pressure at the nozzle outlet, in the longitudinal direction of the nozzle-supporting chassis, the nozzle-supporting chassis only comprising a single pressure levelling chamber. Moreover, maintenance for such a device is tedious since the inner pipe, and in particular the holes on the upper face thereof, are not accessible from outside the nozzle-supporting chassis.

Furthermore, patent document JP S62 3203 U discloses a cooling device used on a rolling mill installation. Such a device comprises a feed pipe, a plurality of nozzles, fixed to a plate, itself fixed to the feed pipe, and communicating therewith via holes. Said plate takes on the form of a tube with a square cross-section and defines a chamber between the feed hose and the nozzles.

Such a device has the drawback of not guaranteeing a uniform optimum pressure at the nozzle outlet, in the longitudinal direction of the nozzle-supporting chassis, the plate only comprising a single pressure levelling chamber.

Finally, patent document JP 2013 013937 A discloses a cooling device intended for cooling steel after a rolling method. Such a cooling device comprises a feed pipe, provided with an opening, through which cooling water is circulated, the other end being closed off by a plate. A plurality of holes is formed on the peripheral surface of the pipe, and distributed evenly in a longitudinal direction of said pipe.

The diameter of the holes decreases in the longitudinal direction of the pipe, from the intake plate to the plate, in order to equalise the feed flow rates through the different holes, in the longitudinal direction of the pipe.

Such a cooling device further comprises a manifold surrounding the pipe, external to said pipe. The manifold is a tubular part having a square cross-section, the side faces whereof are closed off by plates. A slit nozzle is provided inside the manifold, and a rectifier is arranged inside said slit nozzle. The upper portion feeding said nozzle extends above the upper face of the manifold. A first outlet port is provided on one upper face of the manifold near the nozzle. A cover plate, having a substantially parallelepiped shape, covers the first outlet port and the inlet port. Said cover forms a cooling water flow channel connecting the outlet port and the inlet port. A second outlet port, the same size as the first outlet port, is made in the upper wall of the manifold on the other side of the slit nozzle.

Thus, a cooling water flow path is formed and the nozzle is continuously immersed in the cooling water, even when the pipe is not fed with cooling water. The nozzle is therefore not subjected to the heating caused by the passage of the hot metal strip, which would risk deforming the former and thus deteriorating the uniformity of the pressure of the cooling water in a longitudinal direction of the nozzle.

Such a device has the drawback of particularly tedious maintenance since the set of ports, through which the cooling water passes into the manifold, are not accessible from outside said manifold.

SUMMARY OF THE INVENTION

The purpose of the present invention is to propose a spray header that overcomes the aforementioned drawbacks.

Another purpose of the present invention is to propose such a header with easy maintenance.

Other purposes and advantages will appear when reading the following description, which is given for the purpose of illustration only and is not intended to limit the scope of the invention.

The invention thus relates to a spray header intended to lubricate and/or cool a rolled strip and/or the rolls of a rolling mill, comprising:

- a tubular shaft, the hollow interior volume whereof forms a fluid intake chamber,
- a chassis rigidly connected to the external wall of the shaft, extending along said tubular shaft,
- a plurality of nozzles distributed over the length of the chassis and supported by the chassis, arranged such that the jets form a curtain-like sheet of fluid,
- a pipe system, inside said chassis, feeding the nozzles from through-orifices made in the tubular wall of the hollow shaft, said pipe system comprising two pressure-levelling chambers.

According to the invention, the chassis comprises a top wall, a bottom wall, two side walls, rigidly connected to in an impervious manner to the external wall of the shaft, in addition to an end wall supporting bores for the plurality of nozzles, said walls of the chassis forming, with the external wall of the tubular shaft, an enclosure, a partition divides the inner volume of the enclosure into said two pressure-levelling chambers, in series according to the direction of fluid flow, each whereof extends over the entire active length of the chassis, and through which the totality of the fluid feeding said plurality of nozzles successively passes, including:

- a first pressure levelling chamber defined between said partition and the outer wall of the shaft supporting the so-called first orifices,
- a second pressure levelling chamber defined between said partition and the end wall.

According to the invention, the partition supports so-called second orifices distributed throughout the length of the partition.

According to the invention, the number of nozzles forming the plurality of nozzles being an integer N, the number of first orifices and the number of second orifices each being equal to N, each orifice of a nozzle being aligned with one of the first orifices and one of the second orifices, in a direction of alignment that is substantially perpendicular to the axis of the shaft, and such as to allow these three orifices to be cleaned by inserting the same rectilinear tool simultaneously passing through these three openings in the direction of alignment.

According to the invention:

- the machinings of said first orifices are inclined relative to the direction of alignment such that each of the jet outputs of the orifices is directed against a solid wall of the first levelling chamber such as the partition,
- the machining of said second orifices of the intermediate partition are inclined relative to the direction of alignment such that each of the jet outputs of the orifices is directed against a solid wall of the second levelling chamber, such as the end wall.

According to the optional characteristics of the invention, which can be implemented alone or in any combination thereof:

- the sum of the surface areas of the first orifices represents a degree of opening of the intermediate wall between the intake chamber and the first pressure levelling chamber, that lies in the range 2% to 8%;
- the sum of the surface areas of the second orifices represents a degree of opening of the partition between the first pressure chamber and the second pressure chamber, that lies in the range 9% to 15%;
- the one or more side walls of the chassis have at least one opening lateral to said at least one pressure levelling chamber, and at least one removable shutter closing off said lateral opening;
- each of the nozzles comprises a tubular body, having a cylindrical bearing end engaging in an impervious manner with a seat of a wall orifice, the other end having a machining that defines the outlet of the nozzle, each of the nozzles being held by a nut, through which the nozzle passes, engaging, by screwing, with a thread of the orifice in order to compress the bearing end against the seat;
- the header has a mechanical key between the bearing end of the nozzle body and the seat of the orifice, guaranteeing the correct angular positioning of the nozzle body on the axis thereof.

The invention further relates to a rolling mill comprising a rolling mill stand, at least one pair of work rolls capable of defining the gap for the strip to be rolled, in addition to at least one spray header for spraying a lubricating and/or refrigerating fluid, according to the invention, suitable for spraying a sheet of fluid on the strip to be rolled and/or on the rolls of the rolling mill.

According to one embodiment, the rolling mill comprises a feed system for said at least one header, feeding said at least one header from one of the ends of the tubular shaft, the other end of the tubular shaft being closed off.

According to one embodiment, said rolling mill comprises an access window on the operator side from which the rolls of the rolling mill can be removed, the feed system being located on the side of the stand opposite the access window.

The invention further relates to a cooling method implemented by a spray header, or by a spray header of a rolling mill according to the invention, wherein a rolled strip and/or the rolls of a rolling mill are cooled, by the creation of a sheet of fluid generated by the spray header and wherein said header is fed with cooling fluid from only one of the two ends of the tubular shaft.

BRIEF DESCRIPTION OF THE DRAWINGS

The invention will be better understood upon reading the following description, given with reference to the accompanying figures, in which:

- FIG. 5 is a sectional view of a header according to one embodiment of the invention, on a plane passing through the axis of the shaft, showing the pipe system inside said chassis, and which has two pressure levelling chambers, arranged in series in the direction of fluid flow between the hollows of the shaft and said nozzles,
- FIG. 6 is a sectional view of the header according to FIG. 5, on a plane perpendicular to the axis of the shaft,
- FIG. 7 is a more detailed view of FIG. 6 more particularly showing the manner in which the internal orifices (first and second orifices) can be cleaned by inserting a rectilinear tool, as well as the specific inclinations of the jet outputs of the first and second orifices,
- FIG. 8 is a detailed view of a nozzle and the clamping nut thereof, more particularly showing a key comprising lugs of a bearing end of the nozzle body, and complementary cavities on the seat of the wall orifice of the chassis,
- FIG. 9 is a partial view of a rolling mill stand of the 20 High type, comprising two pairs of headers, the two headers of each pair being arranged respectively below and above the plane of the strip to be rolled, the two pairs of headers being arranged on either side of the rolling plane passing through the axes of the work rolls (not shown),
- FIG. 10 is a view of the rear frame, on the side opposite the access hatch of the rolling mill, more particularly showing the fluid feeding system of the headers, located at the rear frame, feeding each of said headers from only one of the ends of the tubular shaft.

DETAILED DESCRIPTION OF THE PREFERRED EMBODIMENTS

Figure 1:
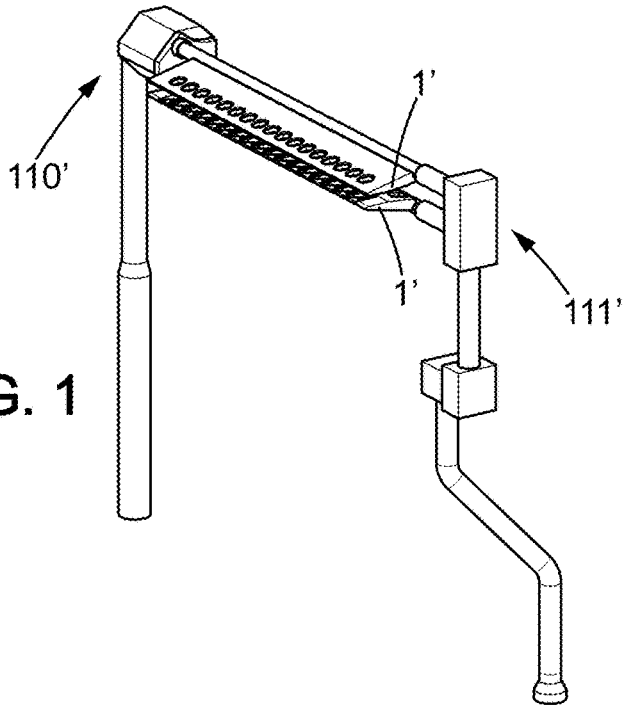
- FIG. 1 is a perspective view showing a pair of spray headers of the prior art, as well as the fluid feeding system thereof which simultaneously feeds the two ends of each of the two tubular shafts of said spray headers.
Figure 2:
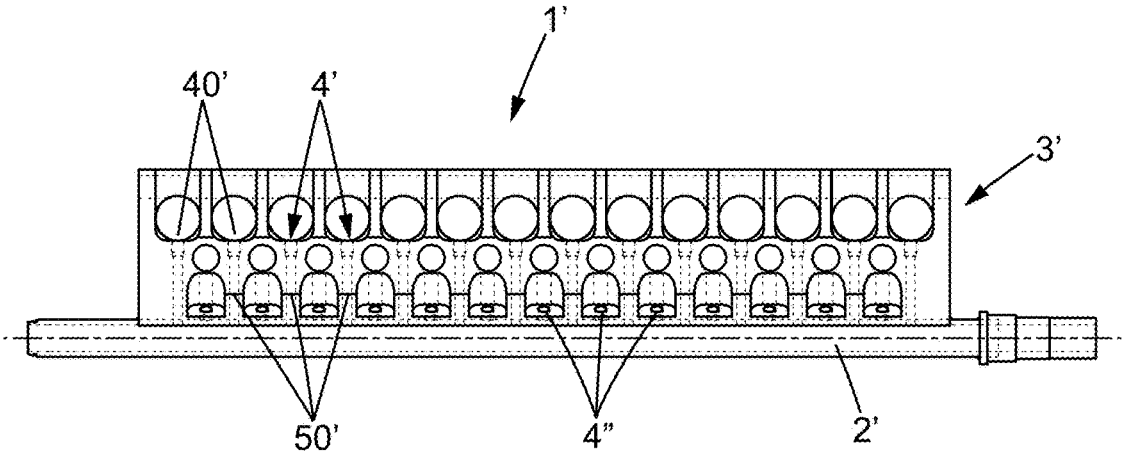
- FIG. 2 is an overhead, transparent view of a header in FIG. 1 showing the individual pipes between the nozzles and the hollow of the shaft.

This document will begin by describing the prior art known to the Applicant, shown in FIGS. 1 and 2. FIG. 1 is a perspective view showing a pair of spray headers according to the prior art, comprising one upper header 1' and one lower header 1'.

FIG. 2 is a transparent view of such a header, showing the internal piping. This header 1' comprises a hollow tubular shaft 2', in addition to a mechanically welded chassis rigidly connected by welding along the length of the shaft 2'. A plurality of nozzles 4' are rigidly connected along the chassis, these nozzles 4' generally being screwed into bores 40' evenly distributed along the length of the chassis. This row of nozzles 4' allows a sheet of fluid to be generated. A second row of nozzles 4" is provided along the chassis, in the immediate vicinity of the shaft, generating a second sheet of fluid, separate from the first. The nozzles 4' of the first row are fed with refrigerating fluid from the hollow of the tubular shaft, each by means of an individual pipe that is substantially radial to the hollow shaft. For each individual pipe, one of the ends of the pipe opens out into the hollow of the shaft via a wall orifice, and the other end is connected to said nozzle. Similarly, the nozzles 4" of the second row are fed with refrigerating fluid from the hollow of the tubular shaft, each by means of an individual pipe.

According to the observations made by the inventor, as a result of the loss of load in the piping upstream of these nozzles 4' or 4", the flow rates of the different nozzles belonging to the same row are not identical. The respective flow rates of the different nozzles belonging to the same row essentially depend on the positions of the nozzles over the length of the header.

Figure 3:
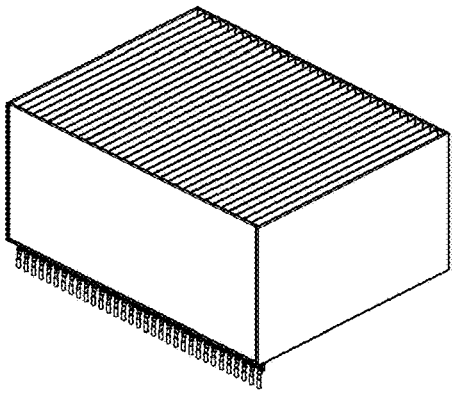
- FIG. 3 is a perspective view of a flow measuring device, suitable for detecting variations in the flow rates of the nozzles of a spray header.

A measuring instrument, shown in FIG. 3, was used to characterise these variations in flow rate. This instrument comprises a plurality of compartments placed end-to-end such that, during test phases, the jets of the different nozzles respectively fill the different compartments of the measuring device.

During testing, the header is fixed to a man-up forklift by a jack. This forklift positions the header directly in front of the measuring device, only once the flow rate of the nozzles has stabilised, and such that the jets of the different nozzles respectively feed the different compartments of the device. The stop watch is then started. As soon as one of the compartments of the measuring device reaches a fluid height limit, the header is immediately moved in translation away from the device and the stop watch is stopped. The measurements of the height of the liquid in the different compartments, of identical cross-sections, allow the flow rate of each nozzle of the header to be calculated.

Figure 4:
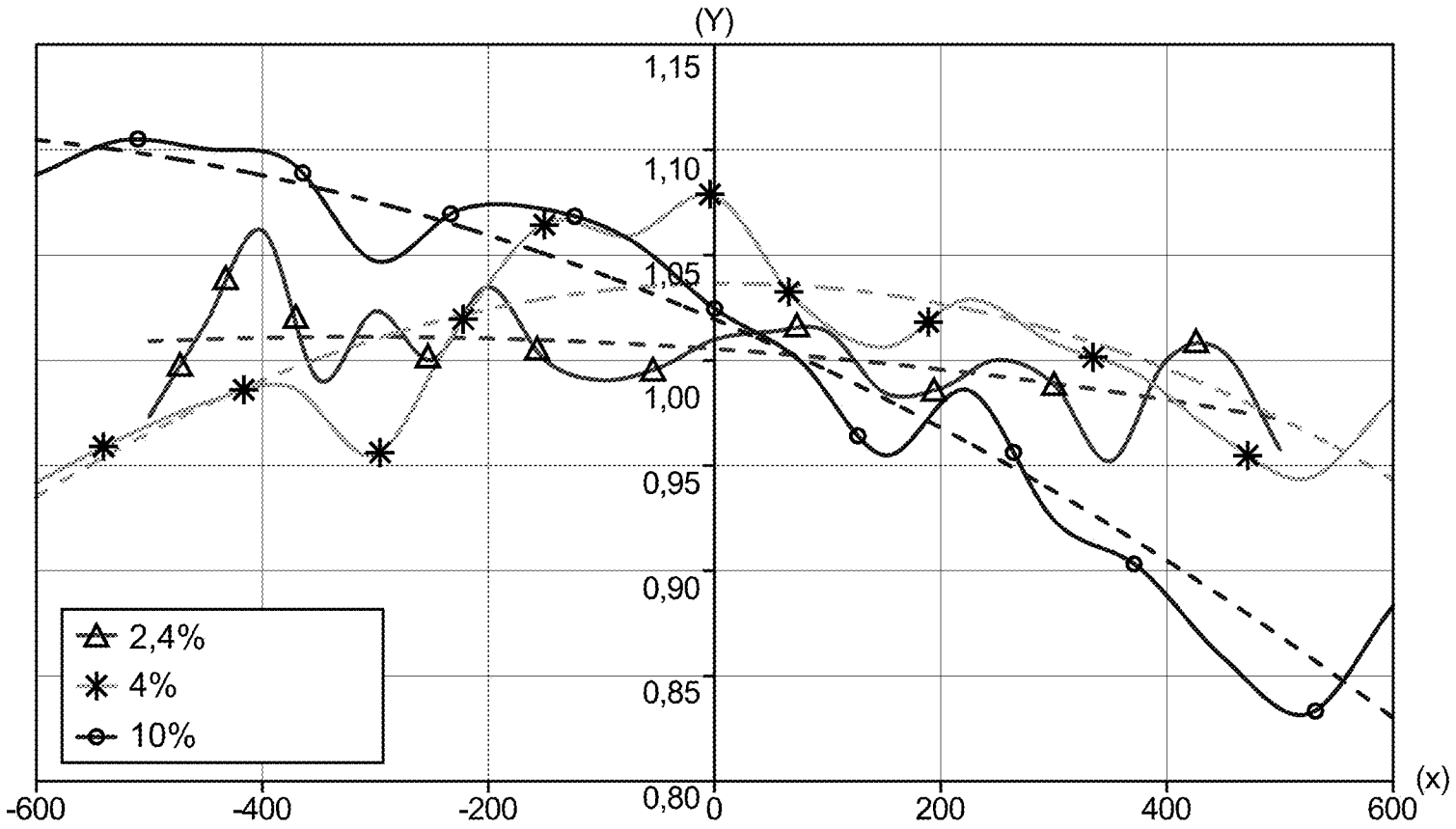
- FIG. 4 is a graph comparing the flow rate distributions of the headers over the length thereof, the y-axis whereof shows flow rate data, and the x-axis whereof shows data on the position over the width of the strip, a first curve showing the distribution of a header according to the invention when fed from a single side, a second curve showing the distribution of a header according to the prior art when fed from both sides, and finally a third curve showing the distribution of the header according to the prior art when fed from a single side.

Such a measuring device has resulted in the production of the second curve on the graph in FIG. 4, which shows the flow rate of the different nozzles (on the y-axis) as a function of the axial position thereof along the header (on the x-axis). This second curve entitled "4%" is obtained when the hollow shaft is fed with fluid simultaneously from the two ends thereof, and as shown in FIG. 1. It is noted that the local average flow rate at the two longitudinal ends of the header is less than the local flow rate in the centre of the header and as shown by an average curve shown in the form of a dotted line. This test was repeated several times. The standard deviation measuring the spread of the flow rate measurements along the length of the header was calculated for each test. The minimum distribution standard deviation is 3.20%, and the maximum distribution standard deviation is 4.18%. The average distribution standard deviation is 3.51%. The second curve represents such a test, for which the standard deviation is 4%.

New tests were conducted using the same header and under the same testing conditions; however, it differs from the previous test in that the header was fed with fluid from only one of the ends of the hollow shaft, and not simultaneously from both ends thereof. This test was repeated several times. The minimum distribution standard deviation is 9.14%, the maximum standard deviation is 11.83%. The average standard deviation is 11.42%, which is highly unsatisfactory. These last tests show why a person skilled in the art does not feed such a header from only one of the two ends thereof, but rather from both ends thereof. The third curve entitled "10%" of the comparative graph in FIG. 4 shows such a test, for which the standard deviation is 10%. A curve in the form of a superimposed dotted line is the average curve of this test.

Thus, the invention relates to a spray header 1 intended to lubricate and/or cool a rolled strip and/or rolls of a rolling mill, comprising:

- a tubular shaft 2, the hollow interior volume whereof forms a fluid intake chamber Ca,
- a chassis 3 rigidly connected to the external wall of the shaft 2, extending along said tubular shaft,
- a plurality of nozzles 4 distributed over the length of the chassis 3 and supported by the chassis,
- a pipe system 5, inside said chassis 3, feeding the nozzles 4 from through-orifices 20 made in the tubular wall of the hollow shaft 2, said pipe system 5 comprising two pressure-levelling chambers 50, 51.

The tubular shaft 2 can be cylindrical, the ends thereof generally being intended to be guided by bearings rigidly connected to the stand of the rolling mill. A cylinder Vr, in particular a hydraulic cylinder, connects the frame and the shaft 2. This actuator is in particular used to pivot the header about the axis of rotation of the shaft, then to firmly hold the header in the desired position.

The nozzles 4 are distributed along the length of the chassis, preferably in an even manner, i.e. with a constant interval between the nozzles which can lie in the range 40 mm to 100 mm, preferably in the range 40 mm to 60 mm, such as 50 mm. These nozzles are preferably aligned in a direction parallel to the axis of the shaft 2. The nozzles are arranged such that the jets form a sheet of fluid.

Said pressure levelling chambers 50, 51 thus extend along the entire active length of the chassis, i.e. at least over the length of the chassis supporting the set of nozzles 4. The purpose of these chambers is to level out (homogenise) the pressure of the fluid over the length of the chassis, and to make uniform the flow rates of the different nozzles 4 over this length. The first orifices 20 along the hollow shaft 2 are distributed along the length of said two pressure levelling chambers. These orifices preferably have the same diameter, and are evenly spaced apart in the axial direction of the shaft.

According to the invention, the chassis 3 comprises a top wall 30, a bottom wall 31, two side walls 32, 33 rigidly connected in an impervious manner to the external wall of the shaft 2, as well as an end wall 34 supporting the bores 40 for the plurality of nozzles 4.

Such an embodiment is shown in FIGS. 5 and 6. These walls 31, 32, 33, 34 of the chassis 3 form an enclosure with the external wall of the tubular shaft 2.

The top wall 30 and the bottom wall 31 preferably extend in a manner parallel to one another. A first longitudinal weld 37 provides the impervious connection between a longitudinal edge of the top wall 30 and a first generatrix of the cylindrical wall of the shaft 2, and a second longitudinal weld 38 provides the impervious connection between a longitudinal edge of the bottom wall 31 and a second generatrix of the cylindrical wall of the shaft 2. The side walls 32, 33 are preferably substantially parallel to one another and perpendicular to the axis of the shaft 2. For each side wall 32 or 33, a peripheral weld (not shown) extends in an arc and provides an impervious connection between an arched edge of the side wall 32 (or 33) and the cylindrical wall of the roll.

According to the invention, a single partition 35 divides the inner volume of the enclosure into two pressure levelling chambers 50, 51 through which the entirety of the fluid feeding said plurality of nozzles 4 successively passes, including:

- a first pressure levelling chamber 50 defined between said partition 35 and the outer wall of the shaft 2 supporting the so-called first orifices 20,
- a second pressure levelling chamber 51 defined between said partition 35 and the end wall 34.

Therefore, the first pressure levelling chamber 50 thus extends:

over a length from one side wall 32 to the other side wall 33, over a width from the external wall of the shaft 2 to the partition 35, and over a height from the bottom wall 31 to the top wall 30.

The second pressure levelling chamber 51 thus extends:

over a length from one side wall 32 to the other side wall 33, over a width from the partition 35 to the end wall 34, and over a height from the bottom wall 31 to the top wall 30.

According to the invention, the two pressure levelling chambers 50, 51 are side-by-side and positioned in series in the direction of flow of the fluid (between the hollow shaft and said nozzles) in the sense that the fluid circulates through the chambers one after the other. There can be two, three or more chambers present. The description below and the example shown provide a header configuration wherein there are two pressure levelling chambers, given the reference numerals 50 and 51.

According to the inventor, a number of pressure levelling chambers of two is a good compromise between the performance levels obtained in terms of homogenisation of the flow rates of the nozzles, the manufacturing cost of the header, and the overall loss of load in the header.

According to the invention, said (or each) partition 35 has so-called second orifices 36, distributed over the length of the partition 35. These second orifices preferably have the same diameter and are distributed in an axial direction of the shaft, preferably in an even manner According to the invention, the number of nozzles forming the plurality of nozzles being an integer N, the number of first orifices and the number of second orifices are each equal to N. Each orifice 40 of a nozzle 4 can thus be aligned with one of the first orifices 20 and one of the second orifices 36, in a direction of alignment that is substantially perpendicular to the axis of the shaft. Such an arrangement advantageously allows, after removing the nozzle 4, these three orifices 20, 36, 40 to be cleaned by inserting the same rectilinear tool, given the reference Or, simultaneously passing through these three openings in the direction of alignment. This tool Or can be successively inserted through each of the orifices 40 to allow all of the first orifices 20 and second orifices 36 to be cleaned.

It should be noted that the diameter of the second orifices 36 is preferably greater than the diameter of the first orifices 20.

According to the invention, the machinings of said first orifices 20 can be inclined relative to the direction of alignment such that each of the jet outputs of the orifices is directed against a solid wall of the first levelling chamber 50, such as the partition 35. As shown by the dotted line in FIG. 7, each machining of a first orifice 20 is inclined relative to the direction of alignment such that the jet output of this orifice 20 is directed against a solid wall such as the partition 35, and not in the axis of an orifice 36 of said partition.

Similarly, according to the invention, the machinings of said second orifices 36 of the partition 35 are inclined relative to the direction of alignment such that each of the jet outputs of the orifices is directed against a solid wall of the second levelling chamber 51, such as the end wall 34. As shown by the dotted line in FIG. 7, each machining of a second orifice 36 is inclined relative to the direction of alignment such that the jet output of this orifice 36 is directed against a solid wall such as the end wall 34, and not in the axis of an orifice 40 of the nozzle 4.

As shown in the figures, the inclinations of the orifices 20 or 36 relative to the direction of alignment can be equal to about 20°, and for example lie in the range 15° to 25°. The angles of inclination of the machinings can be alternated over the length of the partition for the orifices 36 (or of the shaft for the orifices 20).

According to one embodiment:

the sum of the surface areas of the first orifices 20 represents a degree of opening of the intermediate wall between the intake chamber Ca and the first pressure levelling chamber 50, that lies in the range 2% to 8%, such as, for example, 5%;

the sum of the surface areas of the second orifices 40 represents a degree of opening of the partition 35 between the first pressure chamber 50 and the second pressure chamber 51, that lies in the range 9% to 15%, such as, for example, 12%.

In other words, and according to the example shown in FIGS. 5 and 6, the surface area of the intermediate wall "Sin t" between the intake chamber Ca and the first chamber 50 can be approximated by the following calculation:

$$\text{Sin } t = L \times h$$

where "L" is the length of the intermediate wall as shown in FIG. 5 and where "h" is the height of this wall as shown in FIG. 6.

According to the example shown, the surface area of the partition 35 is substantially identical. When the degree of opening of the intermediate wall is 5%, this means that the sum of the surface areas of the first orifices is equal to 5% of the surface area Sin t. When the degree of opening of the partition is 12%, this means that the sum of the surface areas of the first orifices is equal to 12% of the surface area of this partition 35.

According to one embodiment, the one or more side walls 32, 33 of the chassis have at least one opening 53, 54 lateral to said at least one pressure levelling chamber 50, 51, and at least one removable shutter 55, 56 closing off said lateral opening. This opening lateral to said chamber eases cleaning, for example by the insertion of a water jet. According to one embodiment shown, the two side walls at the ends of each pressure levelling chamber 50, 51 have such openings. Two openings 53 and 54 of the side wall 32 respectively provide access to the first pressure levelling chamber 50 and to the second pressure levelling chamber 51. Similarly, the other side wall 33 has two further openings respectively providing access to the first pressure levelling chamber 50 and to the second pressure levelling chamber 51, at the other end of the chambers.

Each of the nozzles 4 can comprise a tubular nozzle body 41, having a bearing end 46 engaging in an impervious manner with a seat 45 of an orifice 40 of the end wall 34. The other end of the body has a machining 47 defining the outlet of the nozzle 4, and thus the shape of the jet output. Each of the nozzles 4 can be held in place by a nut 42, through which passes the nozzle body, engaging, by screwing, with a threading (internal thread) of the orifice 40 in order to compress the bearing end 46 against the seat 45 of the orifice 40. It should be noted that the bearing end 46 can be formed by a cylindrical shoulder, the diameter whereof is greater than the outer diameter of the tubular body 41. The assembly can comprise a mechanical key 43, 44 between the bearing end 46 of the nozzle body and the seat 45 of the orifice, guaranteeing the correct angular positioning of the nozzle body about the axis thereof. The bearing end 46 (in particular the shoulder) can thus comprise one or more radial lugs 43 and the seat 45 can comprise one or more complementary cavities 44 for the lugs 43. The assembly of the nozzle body such that it bears against the surface of the seat is only possible when the or when each lug 43 is not penetrating the corresponding complementary cavity 44. These are nozzles devoid per se of any flow rate control system.

The measuring instrument shown in FIG. 3 was used to characterise the variations in the flows rates of the header according to the invention, shown in FIGS. 5 and 6, and for which the degree of opening of the wall is 5% for the intermediate wall and 12% for the partition 35.

During testing, the header is fixed to a man-up forklift by a jack. This forklift positions the header directly in front of the measuring device, only once the flow rate of the nozzles has stabilised, and such that the jets of the different nozzles respectively feed the different compartments of the device. The stop watch is then started. As soon as one of the compartments of the measuring device reaches a fluid height limit, the header is immediately moved in translation away from the device and the stop watch is stopped. The measurements of the height of the liquid in the different compartments, of identical cross-sections, allow the flow rate of each nozzle of the header to be calculated. This test was repeated several times. The standard deviation measuring the spread of the flow rate measurements along the length of the header was calculated for each test. The minimum distribution standard deviation is 1.31%, and the maximum distribution standard deviation is 2.96%. The average distribution standard deviation is 2.17%. These measurements were obtained when the header was fed with fluid from a single end of the tubular shaft, the other end being closed off (i.e. feeding from only one side of the shaft).

These tests were repeated by feeding the header with fluid from both ends thereof (i.e. feeding from both sides of the shaft). The minimum distribution standard deviation is 1.61%, and the maximum distribution standard deviation is 2.14%. The average distribution standard deviation is 1.95%.

The performance levels of the header according to the invention (in FIGS. 5 and 6) and according to the prior art (in FIGS. 1 and 2) are summarised in the table below.

| Standard | Header according to the invention (FIG. 5 and 6) | | | Prior art (FIG. 1 and 2) | | |
|---|---|---|---|---|---|---|
| deviation | Min | Max | Average | Min | Max | Average |
| 1 side | 1.31% | 2.96% | 2.17% | 9.14% | 11.83% | 11.42% |
| 2 sides | 1.61% | 2.14% | 1.95% | 3.20% | 4.18% | 3.51% |

The first curve entitled "2.4%" of the comparative graph in FIG. 4 shows such a test, for which the standard deviation is 2.4%. A curve in the form of a superimposed dotted line is the average curve of this test.

It should be noted that the header according to the invention procures improved performance levels, even when fed from a single side, and in comparison with the header of the prior art fed from both sides of the shaft.

The invention further relates to a rolling mill 100 comprising a rolling mill stand, at least one pair of work rolls capable of defining the gap for the strip to be rolled, in addition to at least one spray header for spraying a lubricating and/or refrigerating fluid, according to the invention, suitable for spraying a sheet of fluid on the strip to be rolled and/or on the rolls of the rolling mill. The rolling mill can be a "20 High" rolling mill.

As shown in FIG. 8, which shows the rear frame of a 20 High rolling mill and said spray headers 1, the rolling mill can comprise two pairs of headers 1, the two headers of each pair being respectively arranged below and above the plane of the strip to be rolled. The two pairs of headers are conventionally arranged on either side of the rolling plane, passing through the axes of the work rolls (not shown).

The tubular shaft 2 of each header is cylindrical, the ends thereof being guided by bearings rigidly connected to the stand of the rolling mill. A cylinder Vr, in particular a hydraulic cylinder, connects the frame and the shaft 3. This actuator is in particular used to pivot the header 1 about the axis of rotation of the shaft, then to firmly hold the header in the desired position.

The rolling mill comprises a feed system 110 for said at least one header 1, feeding said at least one header from one of the ends of the tubular shaft 2, the other end of the tubular shaft being closed off. This feed system 110 is situated on the side of the stand opposite the access window via which the rolls of the rolling mill can be removed. In other words, and from the operator side, the access window is devoid of any fluid feed system for the one or more headers.

The invention further relates to a cooling method implemented by a spray header, according to the invention, or by a spray header of a rolling mill according to the invention, wherein a rolled strip and/or the rolls of a rolling mill are cooled, by the creation of a sheet of fluid generated by the spray header and wherein said header is fed with cooling fluid from only one of the two ends of the tubular shaft.

NOMENCLATURE

Invention (FIGS. 5 to 10):

- 1. Spray header,
- 2. Shaft,
- 20. Orifices in the shaft wall, referred to as the first orifices,
- 3. Chassis,
- 30, 31, 32, 33, 34. Walls of the chassis respectively the top, bottom, side (on the left in FIG. 5), side (on the right in FIG. 5) and end walls,
- 35. Partition,
- 36. Orifices (partition), referred to as the second orifices,
- 37, 38. Welds,
- 4. Nozzles,
- 40. Orifices in the wall of the chassis (for the nozzles),
- 41. Tubular nozzle body,
- 42. Nut,
- 43, 44. Lugs of the nozzle body and complementary cavities of the mechanical key,
- 45. Seat,
- 46. Cylindrical bearing end (tubular nozzle body),
- 47. Nozzle body outlet machining,
- 5. Pipe system (inside the chassis),
- 50, 51. Pressure levelling chamber,
- 53, 54. Lateral opening (side walls),
- 55, 56. Shutters,
- 100. Rolling mill,
- 110. Feed system,
- Ca. Intake chamber,
- Or. Rectilinear tool (cleaning),
- Vr. Cylinder.

Prior Art (FIGS. 1 and 2):

- 1'. Spray header,
- 110', 111'. Fluid feed system,
- 2'. Shaft,
- 3'. Chassis,
- 40'. Nozzle orifices,
- 50'. Individual pipes.

The invention claimed is:

1. A spray header for lubricating and/or cooling a rolled strip and/or rolls of a rolling mill, comprising:

a tubular shaft, a hollow interior volume of said tubular shaft forming a fluid intake chamber;

a chassis rigidly connected to a wall of the tubular shaft and extending along said tubular shaft;

a plurality of nozzles distributed over a length of the chassis and supported by the chassis, said nozzles arranged to generate jets that form a sheet of fluid; and a pipe system, inside said chassis, that feeds the nozzles from first orifices made in the wall of the tubular shaft, said pipe system comprising two pressure-levelling chambers, wherein the chassis has walls comprising a top wall, a bottom wall, and two side walls, rigidly connected to the wall of the tubular shaft, in addition to an end wall supporting bores for the plurality of nozzles, the walls of the chassis forming, with the wall of the tubular shaft, an enclosure, wherein a partition divides an inner volume of the enclosure into said two pressure-levelling chambers, in series according to a direction of fluid flow, each of said two pressure-levelling chambers extending over an entire active length of the chassis from a first of the two side walls to a second of the two side walls, and through which a totality of the fluid feeding said plurality of nozzles successively passes, said two pressure-levelling chambers including:

a first pressure-levelling chamber defined between said partition and the wall of the tubular shaft supporting the first orifices, and a second pressure-levelling chamber defined between said partition and the end wall, wherein the partition supports second orifices distributed throughout a length of the partition, wherein a number of nozzles forming the plurality of nozzles is an integer N, and a number of first orifices and a number of second orifices are each equal to N, wherein each bore of the nozzles is aligned with one of the first orifices and one of the second orifices, in a direction of alignment that is substantially perpendicular to an axis of the tubular shaft, and such as to allow cleaning by insertion of a same rectilinear tool simultaneously passing through the bore, the one of the first orifices and the one of the second orifices in the direction of alignment, and wherein:

machining of said first orifices are inclined relative to the direction of alignment such that outputs of the first orifices is directed against a solid wall of the first pressure-levelling levelling chamber, and machining of said second orifices of the partition are inclined relative to the direction of alignment such that outputs of the second orifices is directed against a solid wall of the second pressure-levelling chamber.

2. The spray header according to claim 1, wherein:

a sum of surface areas of the first orifices represents a degree of opening of an intermediate wall between the intake chamber and the first pressure-levelling chamber, that lies in a range 2% to 8% of the surface of the partition, and a sum of surface areas of the second orifices represents a degree of opening of the partition between the first pressure-levelling chamber and the second pressure-levelling chamber, that lies in the range 9% to 15% of the surface of the partition.

3. The spray header according to claim 2, wherein the two side walls of the chassis have two openings respectively lateral to said two pressure-levelling chambers, and two removable shutters respectively closing off said two lateral openings.

4. The spray header according to claim 2, wherein each of the nozzles comprises a tubular body, having a cylindrical bearing end engaging with a seat of the bore, and a second end having a machining that defines the outlet of the nozzle, each of the nozzles being held by a nut, through which the nozzle passes, engaging, by screwing, with a thread of the bore in order to compress the bearing end against the seat.

5. A rolling mill, comprising: a rolling mill stand, at least one pair of work rolls configured to define a gap for a strip to be rolled, in addition to at least one spray header for spraying a lubricating and/or refrigerating fluid, according to claim 2, for spraying a sheet of fluid on the strip to be rolled and/or on rolls of the rolling mill.

6. A cooling method implemented by a spray header according to claim 2, wherein a rolled strip and/or rolls of a rolling mill are cooled, by creation of a sheet of fluid generated by the spray header and wherein said header is fed with cooling fluid from only one of two ends of the tubular shaft.

7. The spray header according to claim 1, wherein the two side walls of the chassis have two openings respectively lateral to said two pressure-levelling chambers and two removable shutters respectively closing off said two lateral openings.

8. The spray header according to claim 7, wherein each of the nozzles comprises a tubular body, having a cylindrical bearing end engaging with a seat of the bore, and a second end having a machining that defines the outlet of the nozzle, each of the nozzles being held by a nut, through which the nozzle passes, engaging, by screwing, with a thread of the bore in order to compress the bearing end against the seat.

9. A rolling mill, comprising: a rolling mill stand, at least one pair of work rolls configured to define a gap for a strip to be rolled, in addition to at least one spray header for spraying a lubricating and/or refrigerating fluid, according to claim 7, for spraying a sheet of fluid on the strip to be rolled and/or on rolls of the rolling mill.

10. A cooling method implemented by a spray header according to claim 7, wherein a rolled strip and/or rolls of a rolling mill are cooled, by creation of a sheet of fluid generated by the spray header and wherein said header is fed with cooling fluid from only one of two ends of the tubular shaft.

11. The spray header according to claim 1, wherein each of the nozzles comprises a tubular body, having a cylindrical bearing end engaging with a seat of the bore, and a second end having a machining that defines an outlet of the nozzle, each of the nozzles being held by a nut through which the nozzle passes, engaging, by screwing, with a thread of the bore in order to compress the bearing end against the seat.

12. The spray header according to claim 11, further comprising:

a mechanical key located between the bearing end of the nozzle body and the seat of the orifice to provide a correct angular positioning of the nozzle body on the axis thereof.

13. A rolling mill, comprising: a rolling mill stand, at least one pair of work rolls configured to define a gap for a strip to be rolled, in addition to at least one spray header for spraying a lubricating and/or refrigerating fluid, according to claim 12, for spraying a sheet of fluid on the strip to be rolled and/or on rolls of the rolling mill.

14. A rolling mill, comprising: a rolling mill stand, at least one pair of work rolls configured to define a gap for a strip to be rolled, in addition to at least one spray header for spraying a lubricating and/or refrigerating fluid, according to claim 11, for spraying a sheet of fluid on the strip to be rolled and/or on rolls of the rolling mill.

15. A rolling mill, comprising; a rolling mill stand, at least one pair of work rolls configured to define a gap for a strip to be rolled, in addition to at least one spray header for spraying a lubricating and/or refrigerating fluid, according to claim 1, for spraying a sheet of fluid on the strip to be rolled and/or on rolls of the rolling mill.

16. The rolling mill according to claim 15, further comprising: a feed system for said at least one header, that feeds said at least one header from a first end of the tubular shaft, the second end of the tubular shaft being closed off.

17. The rolling mill according to claim 16, further comprising: an access window on an operator side from which the rolls of the rolling mill can be removed, the feed system being located on a side of the stand opposite the access window.

18. The rolling mill according to claim 15, further comprising: an access window on an operator side from which the rolls of the rolling mill can be removed, the feed system being located on a side of the stand opposite the access window.

19. A cooling method implemented by a spray header according to claim 1, wherein a rolled strip and/or rolls of a rolling mill are cooled, by creation of a sheet of fluid generated by the spray header, and wherein said header is fed with cooling fluid from only one of the two ends of the tubular shaft.

20. The spray header of claim 1, wherein the solid wall of the first pressure-levelling chamber is the partition, and the solid wall of the second pressure-levelling chamber is the end wall.

* * * * *